US005918584A

United States Patent [19]

Kato

[11] Patent Number: 5,918,584

[45] Date of Patent: Jul. 6, 1999

[54] ENGINE CONTROL SYSTEM

[75] Inventor: Masahiko Kato, Hamamatsu, Japan

[73] Assignee: Sanshin Kogyo Kabushiki Kaisha, Shizuoka-ken, Japan

[21] Appl. No.: 08/840,398

[22] Filed: Apr. 29, 1997

[30] Foreign Application Priority Data

Apr. 30, 1996 [JP] Japan ..... 8-109308

[51] Int. Cl.[6] ..... F02D 41/14; F02D 41/22

[52] U.S. Cl. ..... 123/681; 123/688; 123/694

[58] Field of Search ..... 123/479, 688, 123/694, 695, 696, 681; 73/118.1

[56] References Cited

U.S. PATENT DOCUMENTS

| | | | |
|---|---|---|---|
| 4,142,482 | 3/1979 | Asano et al. | 123/696 X |
| 4,624,232 | 11/1986 | Saito et al. | 123/695 |
| 5,052,361 | 10/1991 | Ono et al. | 123/688 |
| 5,065,728 | 11/1991 | Nakaniwa | 123/688 X |
| 5,235,957 | 8/1993 | Furuya | 123/688 |
| 5,370,101 | 12/1994 | Hamburg et al. | 123/696 X |
| 5,526,798 | 6/1996 | Seki | 123/688 |
| 5,568,725 | 10/1996 | Uchikawa | 123/688 X |

*Primary Examiner*—Tony M. Argenbright
*Attorney, Agent, or Firm*—Knobbe, Martens, Olson & Bear LLP

[57] ABSTRACT

Several embodiments of feedback control systems for either two or four-cycle engines that employ sensors such as oxygen sensors. The systems include an arrangement wherein the sensor condition is determined by comparing the response time with a normal response time. If the time of response is outside of the normal range, compensation may be made so as to permit continued feedback control. Embodiments are also describe that adjust the maximum permissible injection amount and also revert to an open control if the deterioration is more any predetermined amount.

16 Claims, 12 Drawing Sheets

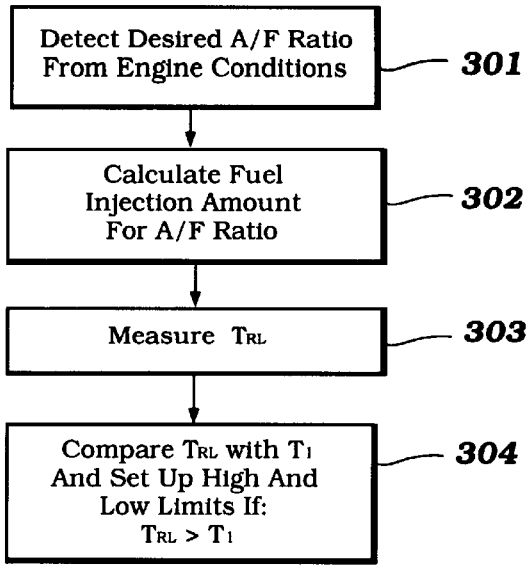
*Figure 15*
*Figure 16*
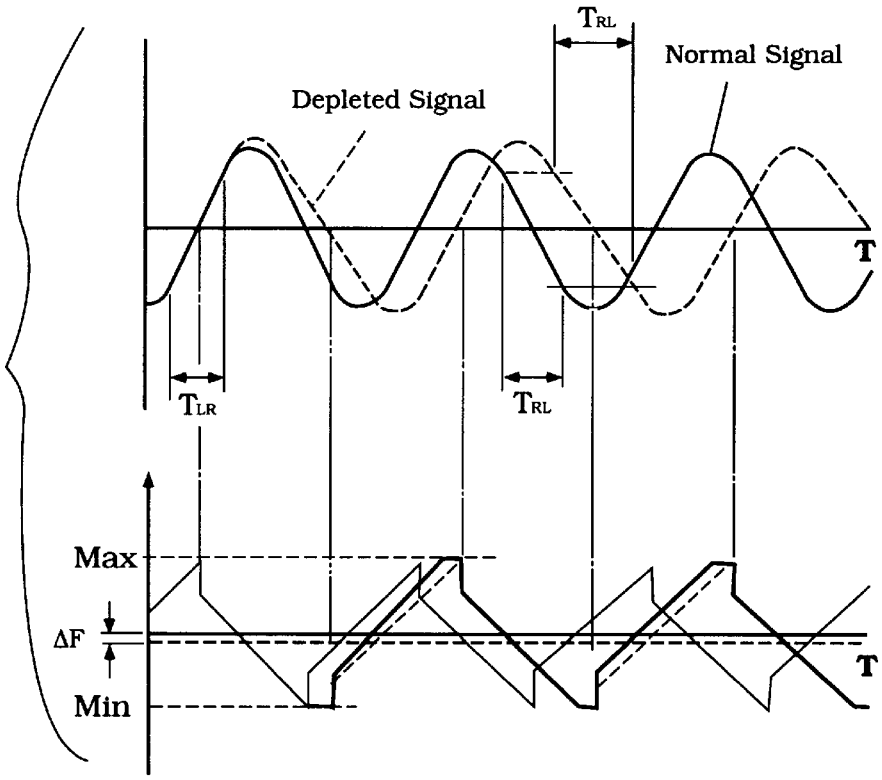

ENGINE CONTROL SYSTEM

BACKGROUND OF THE INVENTION

This invention relates to an engine control system and more particularly to an improved feedback control system for internal combustion engines.

In the interests of improving fuel economy and exhaust emission control, a wide variety of types of engine control systems have been proposed. Many forms of these systems employ combustion conditions sensors such as oxygen sensors. These sensors are capable of determining the actual air-fuel ratio in the combustion chamber at the time of combustion. An oxygen sensor ($O_2$) operates to do this by measuring the amount of oxygen remaining in the residual exhaust gasses. From this, it is possible to obtain an indication whether the air-fuel ratio is at the desired value.

By utilizing such a control, it is possible to actually adjust the engine's running conditions from cycle to cycle and achieve good exhaust emission control and good fuel economy. These types of sensors, and particularly the oxygen type sensor, however provide generally an on/off signal. That is, the sensor basically changes its state from a rich signal to a lean signal when deviations from stoichiometric occur. These sensors, however, since they are exposed directly to the exhaust gasses can become contaminated and fail.

Failure, of course, is relatively easy to detect and arrangements can be made for other types of controls upon such failure. However, at times the sensor may not have a complete failure, but may output a signal that is not truly representative of the air-fuel ratio. If this information is utilized for engine control, then poor control may result.

It is, therefore, a principal object of this invention to provide an improved engine control system embodying a feedback control and sensor and which will provide for compensation for the control in the event the sensor output degrades.

SUMMARY OF THE INVENTION

This invention is adapted to be embodied in an internal combustion engine and control method therefore. The engine comprises a combustion chamber. An induction and charge-forming system supplies fuel and air to the combustion chamber. Means are incorporated for igniting the charge in the combustion chamber for initiating combustion therein. Exhaust means discharge the resulting exhaust gases from the combustion chamber. A combustion condition sensor senses combustion condition in the combustion chamber and provides an output signal indicative of the combustion condition. Feedback control means control the charge-forming system for varying the fuel/air ratio supplied to the combustion chamber in response to the output signal from the combustion condition sensor.

An engine embodying the invention includes means for sensing when the output signal from the combustion condition sensor has degraded. There are further provided means for adjusting the feedback control means to compensate for the degradation in the combustion condition sensor operation to maintain proper feedback control operation.

A method for controlling the engine embodies the sensing when the output signal from the combustion condition sensor has degraded. Then the feedback control means is operated to compensate for the degradation in the combustion condition sensor operation to maintain proper feedback control operation.

BRIEF DESCRIPTION OF THE DRAWINGS

FIG. 15 is a block diagram showing another embodiment of control routine that adjusts the upper and lower fuel amount adjustment limits in the event the reaction time is less than a predetermined value but wherein the sensor still can be utilized for engine control.

FIG. 16 is a block diagram of sensor output signal and fuel injection amount in accordance with the embodiment of FIG. 15.

DETAILED DESCRIPTION OF THE PREFERRED EMBODIMENTS OF THE INVENTION

Figure 1:
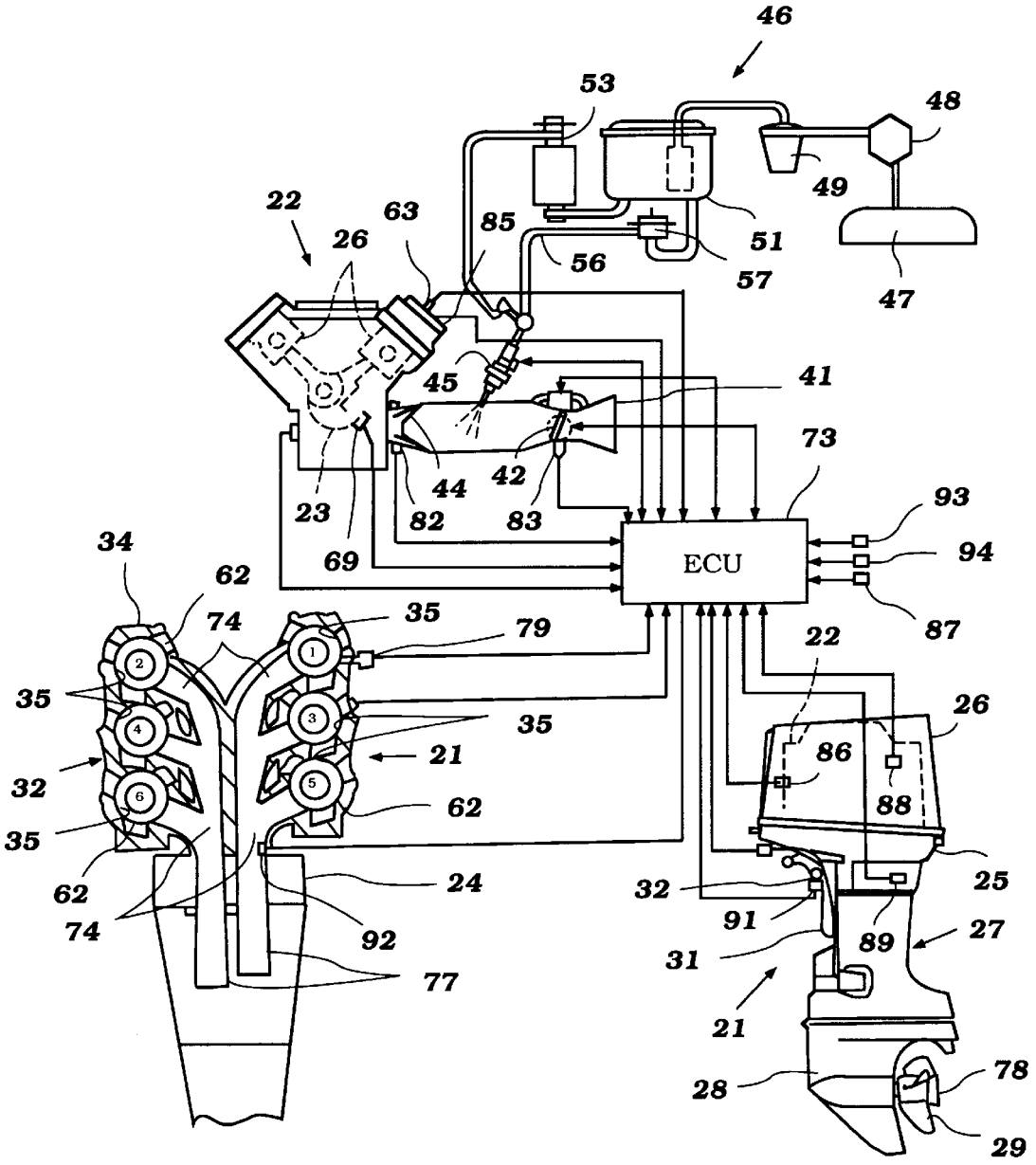
FIG. 1 is a partially schematic three part view showing an outboard motor constructed and operated in accordance with an embodiment of the invention (C ) in side elevation, (B)in rear plan with a portion of the protective cowling removed and a part of the engine broken away along the line B—B of view portion A and (A) in a schematic top plan view of the engine with the fuel supply system and feedback control system being shown in part schematically.
Figure 2:
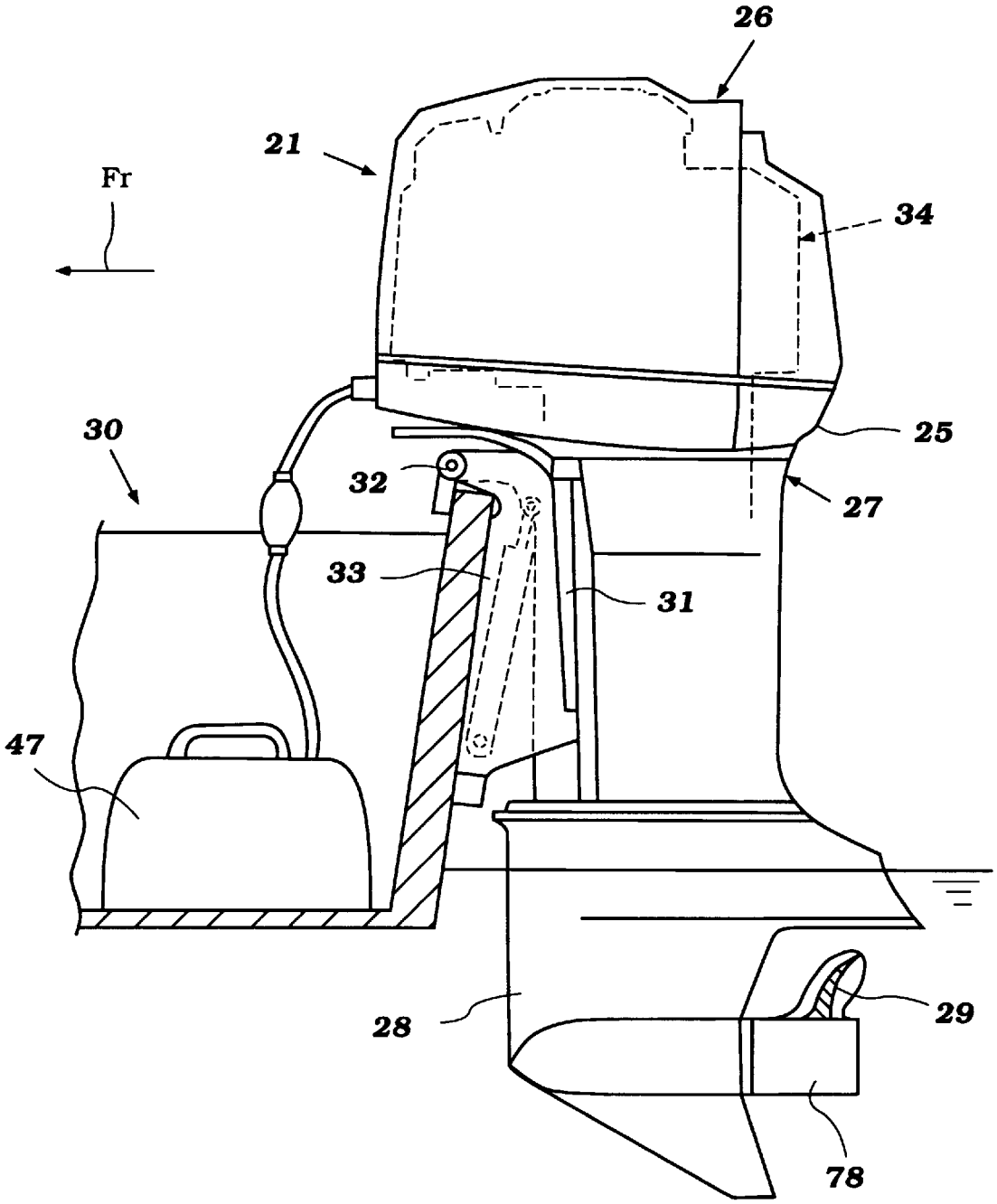
FIG. 2 is an enlarged side elevational view of the outboard motor.

Referring now in detail to the drawings, and to the embodiment of FIGS. 1–14 initially by reference to FIGS.

1–5, an outboard motor is indicated generally by the reference numeral 21. The invention is shown in conjunction with an outboard motor because the invention has particular utility in conjunction with two-cycle crankcase compression engines even though not specifically limited thereto. Such engines are normally used as the propulsion device for outboard motors. For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the aforenoted drive shaft housing, which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft shown in FIG. 2 and identified by the reference numeral 30.

A steering shaft (not shown) is affixed to the drive shaft housing 27. This steering shaft is journaled for steering movement within a swivel bracket 31 for steering of the outboard motor 21 and the associated watercraft 30 in a well-known manner.

The swivel bracket 31 is, in turn, pivotally connected by a pivot pin 32 to a clamping bracket 33 that is adapted to be detachably affixed to the transom of the associated watercraft. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of V six configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines and even with four cycle engines and such an embodiment appears in FIG. 19.

The engine 22 includes a cylinder block 34 having a pair of angularly disposed cylinder banks in each of which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 41 (FIGS. 1,3 and 4) which draws atmospheric air through an inlet formed within the protective cowling.

A throttle body assembly 40 having throttle valves 42 is positioned downstream of the air inlet 41 and is operated in any known manner.

Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiments, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft 30 propelled by the outboard motor 21. Fuel is pumped from the fuel tank 47 by means of a plurality of crankcase chamber pressure driven, low pressure, fuel pumps 48. This fuel is drawn through a fuel filter 49, which is mounted within the power head of the outboard motor 21.

Fuel flows from the fuel pumps 48 through a conduit into a fuel vapor separator 51, which includes a float controlled valve for controlling the level of fuel in the fuel vapor separator 51. Any accumulated vapor will condense, and excess vapor pressure can be relieved through a suitable vent (not shown).

Also mounted, preferably in the fuel vapor separator 51, is a high-pressure fuel pump 53 which is driven in any known manner as by an electric motor. This fuel pump 53 draws fuel from the fuel vapor separator 51 and delivers fuel under high pressure to a fuel rail 54 through a conduit 55. The fuel rail 54 serves each of the injectors 45 associated with the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel vapor separator 51 through a return line 58 (FIG. 1). The regulated pressure may be adjusted electrically along with other controls, as will be described.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a pair of cylinder head assemblies 61 that are affixed to the banks of the cylinder block 34 in any known manner. The charge so formed is transferred to the combustion chamber 59 from the crankcase chambers 38 through one or more scavenge passages 62 (See View B of FIG. 1).

These scavenge passages terminate in scavenge ports that open through the cylinder bores 35 and which are valved by the movement of the pistons 36, as is well known in the two cycle art.

Spark plugs 63 are mounted in the cylinder head 61 and have their spark gaps extending into the combustion chambers 59. The spark plugs 63 are fired by a capacitor discharge ignition system The ignition system is provided with electrical current by a magneto generator assembly, indicated generally by the reference numeral 64. This includes a flywheel 65 having a hub portion 66 that is fixed for rotation with the crankshaft 23 at the upper end thereof. This flywheel 65 carries a plurality of permanent magnets 67 that cooperate with charging coils 68 mounted on the upper end of the engine. In addition, a pulser coil 69 is associated with the crankshaft for providing a pulse signal when the crankshaft rotates which signal is indicative of the rotational speed and angular position of the crankshaft 23.

The magneto generator 64 outputs is electrical current to the CDI ignition system, which is shown schematically at 71 and which may be conveniently mounted in an appropriate location. This outputs a signal to a spark coil which may be mounted on each spark plug 63 for firing the spark plugs 63 in a known manner.

The capacitor discharge ignition circuit is operated, along with certain other engine controls such as the regulated fuel pressure, by an engine management ECU, shown schematically and identified generally by the reference numeral 73.

When the spark plugs 63 fire, the charge in the combustion chambers 59 will ignite and expand so as to drive the pistons 36 downwardly. The combustion products are then discharged through exhaust ports formed in the cylinder block 34. Like the scavenge ports, the exhaust ports are valved by the movement of the pistons.

Figure 3:
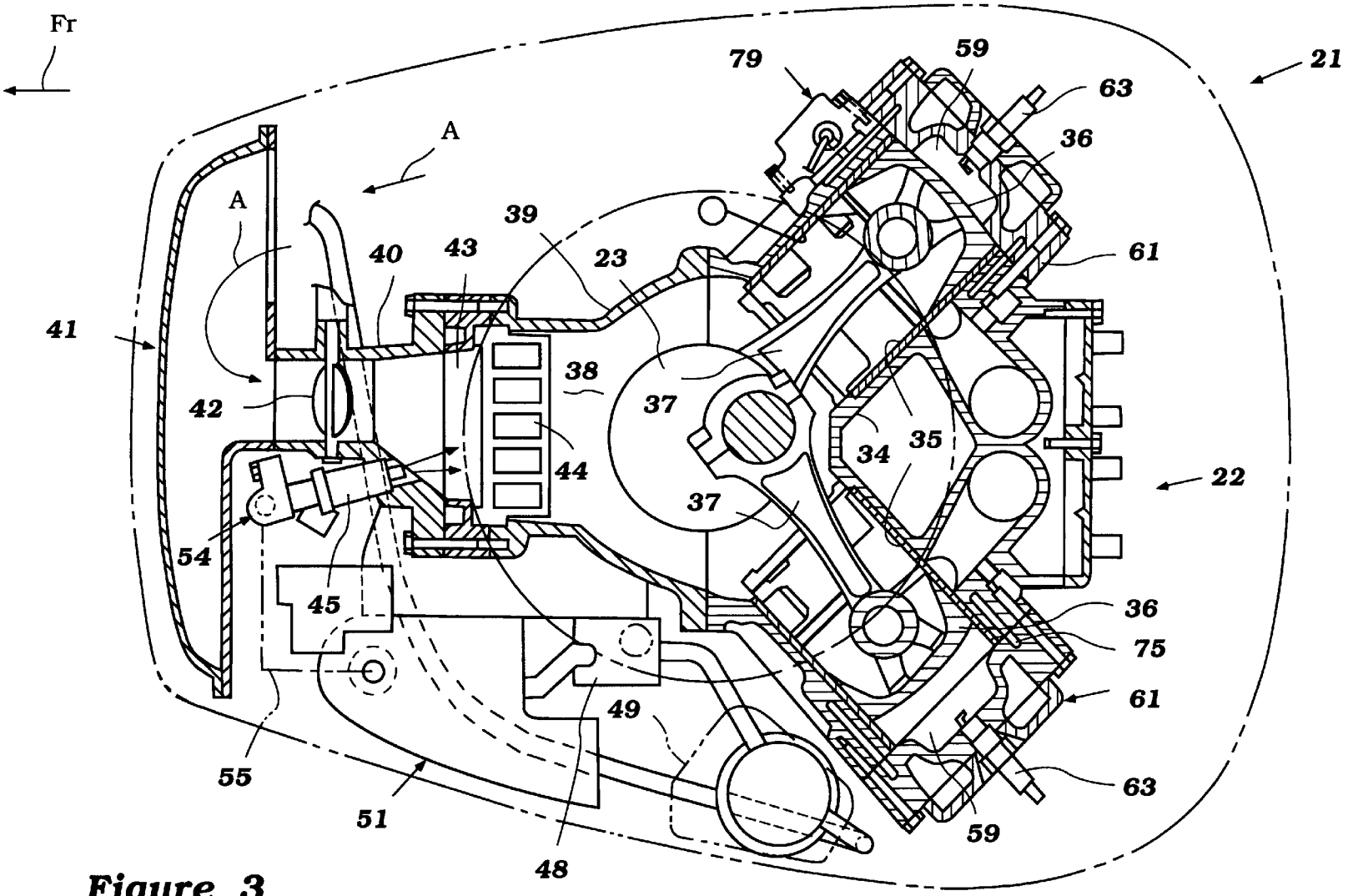
FIG. 3 is a top plan view of the power head of this embodiment with the protective cowling shown in phantom, and the engine shown broken away and in section.
Figure 4:
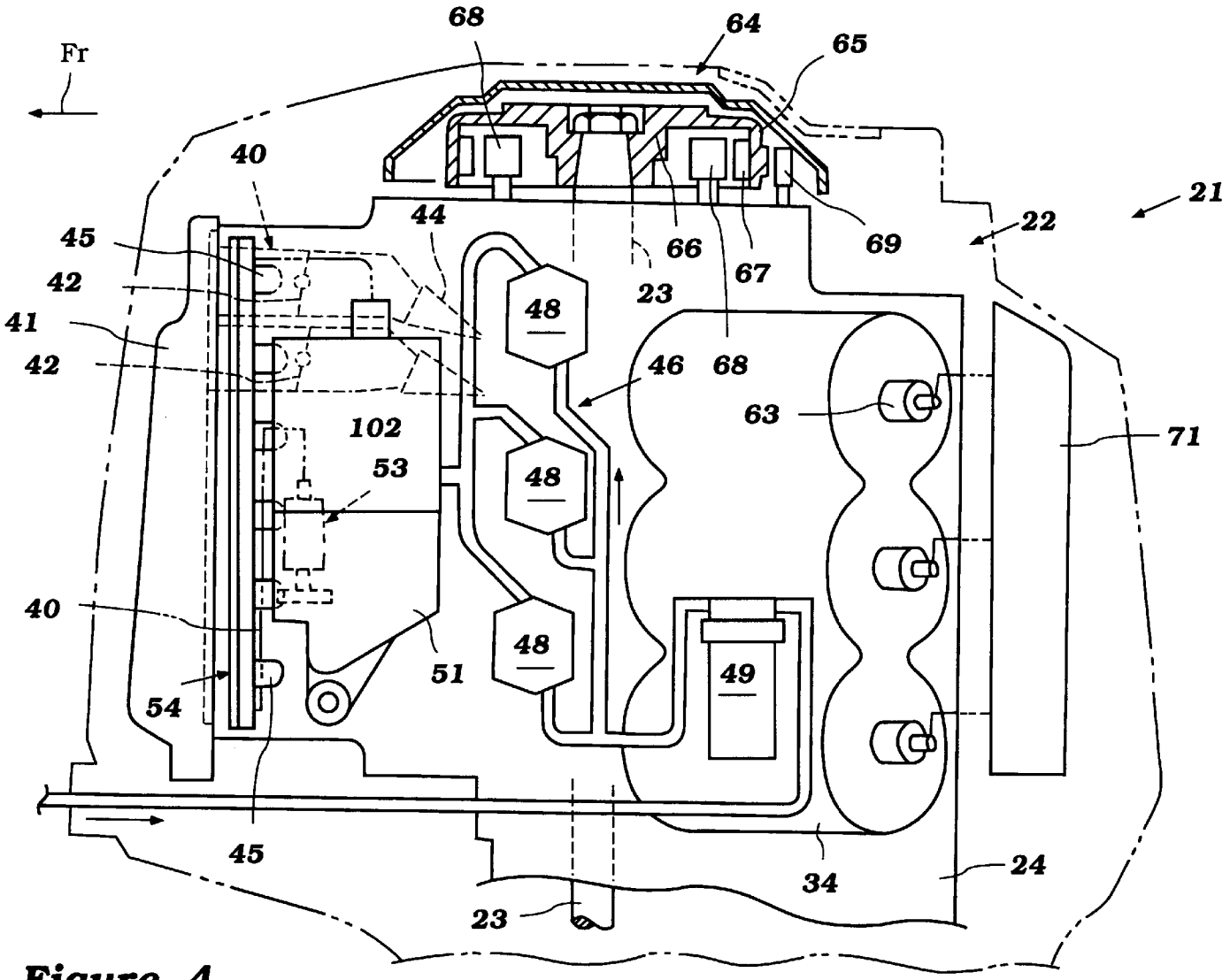
FIG. 4 is a side elevational view of the components shown in FIG. 3 with other portions broken away.

These exhaust gases then flow through a pair of exhaust manifolds, shown in FIGS. 1 and 3 and identified by the reference numeral 74. The exhaust gases then pass downwardly through an opening in the guide plate 24 to an appropriate exhaust system (to be described later) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 75 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing. This will also be described later.

Although not completely shown in the drawings, the engine 22 is also provided with a lubricating system for lubricating the various moving components of the engine 22. This system may spray lubricant into the intake passages in proximity to the fuel injector nozzles 45 and/or may deliver lubricant directly to the sliding surfaces of the engine 22.

Referring now primarily to FIG. 1, the exhaust system for discharging the exhaust gases to the atmosphere will be described. As has been noted, the exhaust manifolds 74 communicate with exhaust passages, indicated by the reference numeral 76, that is formed in the spacer or guide plate 24. Exhaust pipes 77 are affixed to the lower end of the guide plate 24 and receive the exhaust gases from the passages 76.

The exhaust pipes 77 depend into an expansion chamber formed within the outer shell of the drive shaft housing 27. This expansion chamber communicates with an exhaust chamber formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft 30 is operating when traveling at high speeds.

In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft 30 is traveling at a low rate of speed or is idling, and the through-the-hub exhaust gas discharge 78 will be deeply submerged.

As has been previously noted, the cooling water from the engine cooling jacket 75 may also be mixed with the exhaust gases at any suitable point or points in the exhaust system.

It has been noted that the ECU 73 controls the capacitor discharge ignition circuit and the firing of the spark plugs 63. In addition, the ECU controls the fuel injectors 45 so as to control both the beginning and duration of fuel injection and the regulated fuel pressure, as already noted. The ECU 73 may operate on any known strategy for the spark control and fuel injection control, although this system employs an exhaust sensor assembly indicated generally by the reference numeral 79. In addition, the ECU 73 may disable the firing of one or more of the spark plug 63 for a portion of the engine running time in response to certain conditions, such as low speed low load, so as to provide fuel economy.

So as to permit engine management, a number of sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown primarily in FIG. 1 include the aforementioned crankshaft position sensor 69 which senses the angular position of the crankshaft 23 and also the speed of its rotation. A crankcase pressure sensor 81 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 82 may be provided in the intake passage downstream of the throttle valves 42 for sensing the temperature of the intake air. In addition, the position of the throttle valves 42 is sensed by a throttle position sensor 83. Engine temperature is sensed by a coolant temperature sensor 84 that is mounted in an appropriate area in the engine cooling jacket 75. An in-cylinder pressure sensor 85 may be mounted in the cylinder head 61 so as to sense the pressure in the combustion chamber 59. A knock sensor 86 may also be mounted in the cylinder block 34 for sensing the existence of a knocking condition.

Certain ambient conditions also may be sensed, such as atmospheric air pressure by a sensor 87, intake cooling water temperature, as sensed by a sensor 88, this temperature being the temperature of the water that is drawn into the cooling system before it has entered the engine cooling jacket 75.

In accordance with some portions of the control strategy, it may also be desirable to be able to sense the condition of the transmission for driving the propeller 29 or at least when it is shifted into or out of neutral. Thus, a transmission condition sensor 89 is mounted in the power head and cooperates with the shift control mechanism for providing the appropriate indication.

Furthermore, a trim angle sensor 91 is provided for sensing the angular position of the swivel bracket 31 relative to the clamping bracket 33.

Finally, the engine exhaust gas back pressure is sensed by a back pressure sensor 92 that is positioned within the expansion chamber which forms part of the exhaust system for the engine and which is positioned in the drive shaft housing 27.

Other conditions may also be sensed including conditions of the watercraft. These conditions are sensed by a vessel speed sensor 93 and a vessel trim condition sensor 94.

The types of sensors which may be utilized for the feedback control system provided by the ECU 73 are only typical of those which may be utilized in conjunction with the invention. For that reason, further details of the description of the components of the engine and outboard motor that have no particular importance in conjunction with the understanding of the construction and operation of the invention have been deleted.

The various cylinders of the engine will be identified since the oxygen sensor 79 is associated with more than one cylinder of the engine 22. In order to permit this description to be more clearly understood, the cylinders of the engine 22 have been numbered from top to bottom and from right bank and left bank successively as cylinder numbers 1 through 6.

Figure 5:
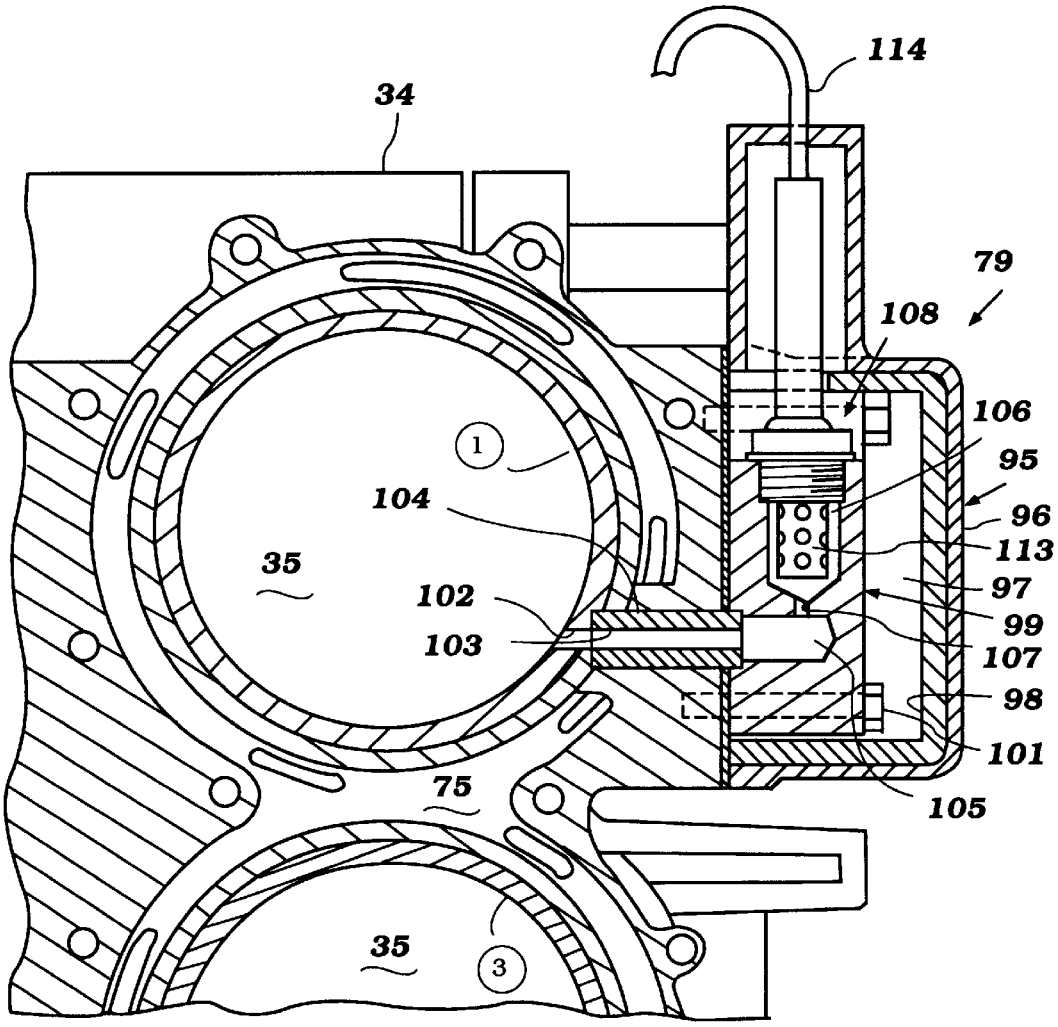
FIG. 5 is a cross-sectional view taken through one of the cylinder banks and depicts the oxygen sensor association therewith.
Figure 6:
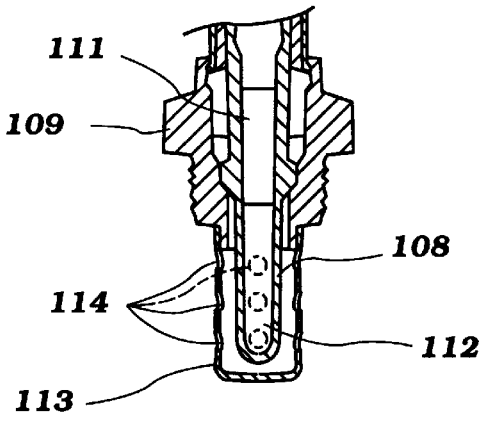
FIG. 6 is an enlarged cross-sectional view taken through the oxygen sensor and showing the actual sensing unit.

The sensor assembly 79 has a construction as best shown in FIGS. 5 and 6. The sensor assembly 79 is comprised of an outer housing assembly, indicated generally by the reference numeral 95. The outer housing assembly 95 is comprised of an outer part 96 which is formed from sheet metal or the like and which defines a cavity 97. The inner surface of the sheet metal member 96 is formed with an insulating lining 98. A further case 99 is mounted within this chamber 97 and is fixed to the cylinder block assembly 34 in proximity to number 1 cylinder by a plurality of threaded fasteners 101.

A small sensing port 102 is formed in the cylinder bore 95 in a position closely adjacent the height of the exhaust port of the number 1 cylinder so that burnt exhaust gasses may pass through a passage 103 formed in a tube 104 that is pressed into the cylinder block and communicates with the passageway 102.

The passageway 103 of the tube 104 communicates with a chamber 105 formed in the member 99. This passageway further communicates with a sensor chamber 106 through a restricted orifice 107. The actual sensor element, indicated by the reference numeral 108 is mounted so as to extend into this chamber 106.

The sensor element itself 108 is mounted in a mounting fitting 109 that is threaded into the body 99. A heater element 111 transfers heat to the body 108. The body 108 is formed from a zirconia material that is plated onto a hollow glass tube.

This sensor element 108 has a hollow interior 112 and is surrounded by a protective shield 113 which has a tubular configuration and which is formed with openings 114 so the combustion products may reach the sensor element 108. A conduit 114 carries the signal from the sensor 108 to the ECU 73.

Basically, the control strategy by which the ECU 73 controls the air-fuel ratio is to sense when the air-flow ratio deviates from stoichiometric or the desired air-fuel ratio by making adjustments in the amount of fuel supplied from an initial target fuel supply amount. The actual control strategy may be of a known type and operates so as to provide a change in the amount of fuel that is injected per cycle by making adjustments in first a large step correction and then subsequent incremental steps until the sensor output changes in the desired direction.

Normally this is done when the output signal reaches either a peak in one direction or in the other direction as may be seen best by the wave form of FIG. 7A. This output signal normally follows a slope shown by the solid line view of FIG. 7A.

The fuel adjustments under this normal operation are shown by the solid line view of 7B. This invention does not deal with the basic control strategy, but rather deals with the way the strategy is modified to compensate for conditions when the center output has been determined to have deteriorated.

This deterioration can be due to the accumulation of certain products such as phosphorus or silicon on the surface of the sensor element 108. These deposits can form from a result of a variety of factors, not the least of which may be the presence of lubricating oil in the exhaust.

However, in accordance with the invention, the system operates so as to still maintain feedback control under this deteriorating condition until the condition deteriorates to a level that feedback control is not feasible. In other words, when the signal is deteriorated but less than a certain amount, feedback control is maintained, but this feedback control is adjusted so as to make the feedback control more accurate.

Figure 7:
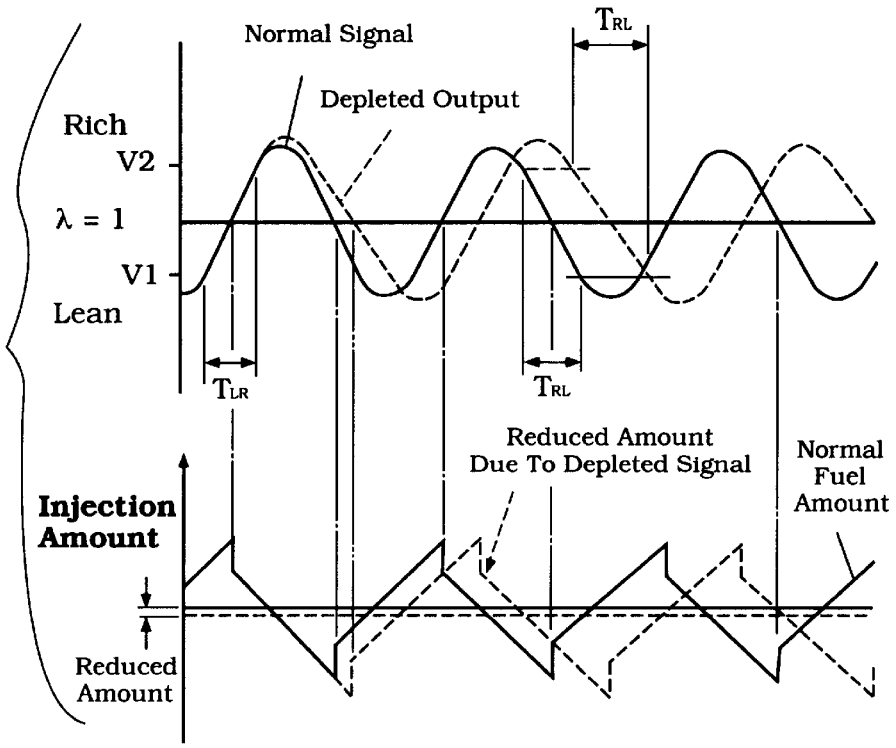
FIG. 7 is a graphical view showing, at the top, the output signal of oxygen sensor and, at the bottom, the fuel injection amount both with a normally operating system in solid lines and with a degraded sensor in phantom lines.

This deteriorated condition is shown by the dotted line views in FIG. 7. As may be seen in this figure, when the signal of the sensor deteriorates, the time of response $T_{lr}$ in the shift from the lean to the rich or $T_{rl}$, rich to the lean side, will become extended. This is because the deteriorated sensor has the effect of reducing the average amount of injection by the amount shown by the dotted line in FIG. 7B. As a result, since the amount of fuel injected is reduced and it basically takes the system longer to respond to the deviation.

Figure 8:
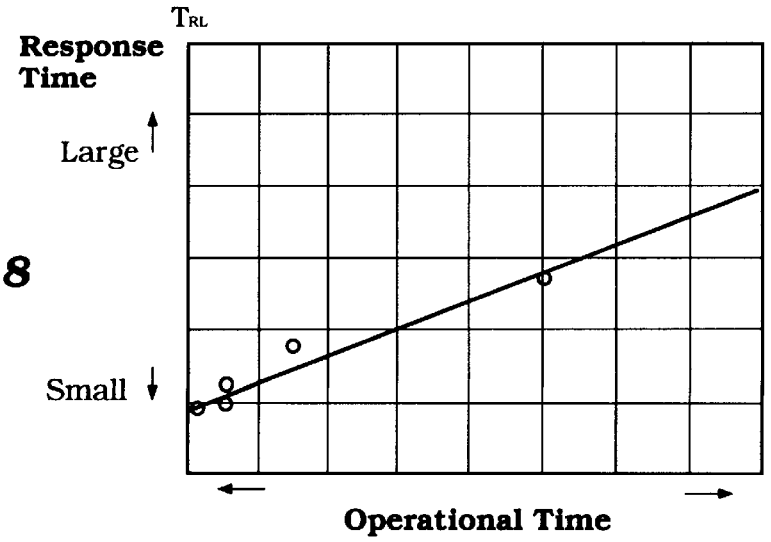
FIG. 8 is a graphical view showing the degradation of the response time as the sensor degrades with running time.
Figure 9:
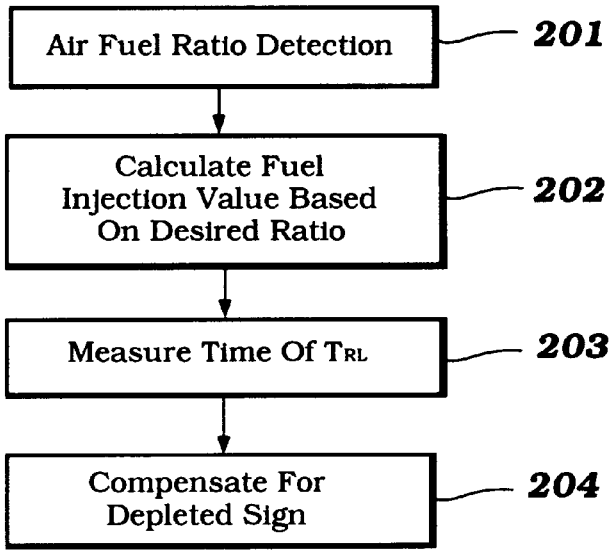
FIG. 9 is a block diagram showing the relationship of the components of the ECU for providing the feedback control.

This also may be understood by reference to FIG. 8 which illustrates how the response time varies during the period of time of operation of the engine. The circle dots indicate the amount of deviation of the fuel signal or the amount of fuel injected as running time accumulates.

Therefore, and in accordance with one feature of the invention, the condition of the sensor 79 is monitored by measuring the response time TRL to determine if the value is greater than a predetermined value which is indicative of the depleted output signal condition aforenoted.

The ECU 73 has a first stage 201 that determine the desired air-fuel ratio based upon the running conditions in accordance with any desired strategy or from a look up map. Then, from this value, the ECU has a stage 202 that calculates the amount of fuel which should be injected in order to achieve the desired air-fuel ratio. The ECU also has a portion 203 which functions to measure the time of response TRL to move from the rich to the lean side. The ECU includes a section 204 that provides a compensation in the volume of amount of fuel injected from the section 202 if required. This is preferably done at a time during rich operation such as at warm up.

Figure 10:
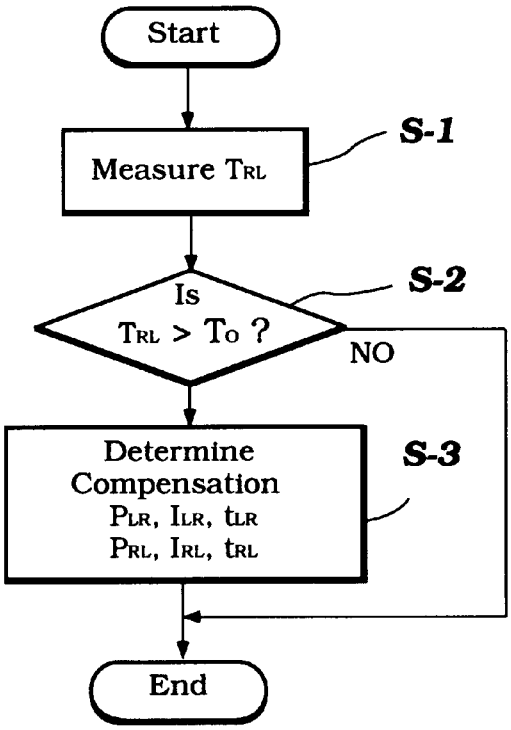
FIG. 10 is a block diagram showing the control routine for determining the fuel injection correction amount for this embodiment.

The program of the ECU thus operates in accordance with the steps shown in FIG. 10 which starts and moves to the first step S1 so as to measure the time TRL. The time TRL is then compared with a target time $T_0$ to determine if the signal depletion has caused a time delay that is greater than that which is desired. If the time TRL is not greater than the time $T_0$ the program steps to the End and does not perform any compensation.

Figure 13:
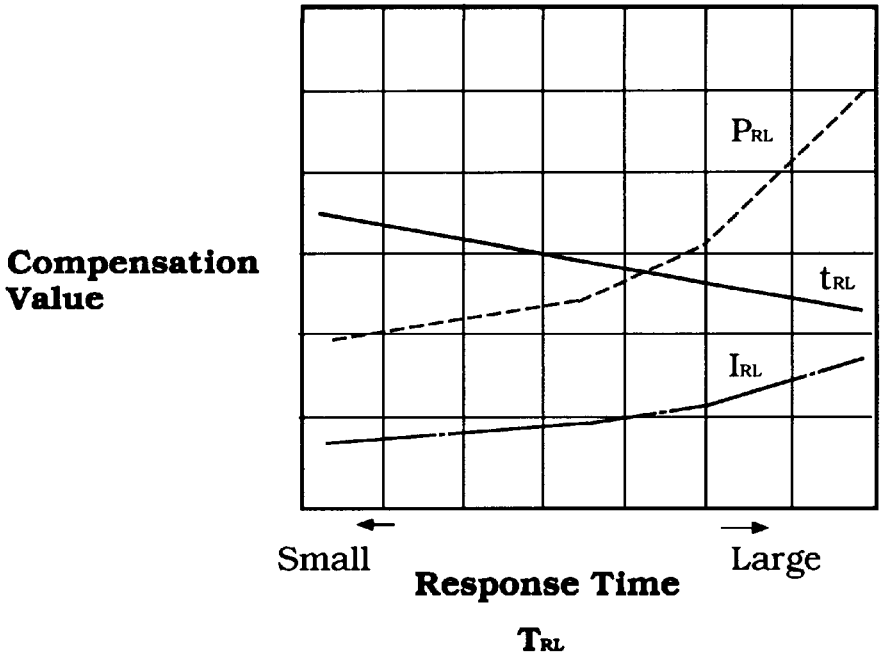
FIGS. 13 and 14 are views showing the compensation values in respect to response time utilized in the maps in accordance with the invention.
Figure 14:
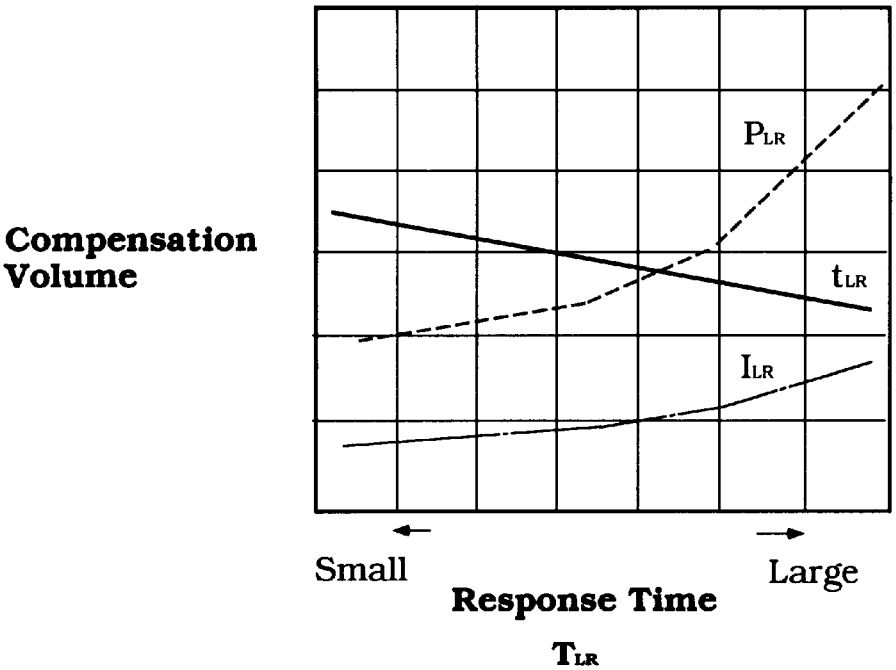

If, however, the time TRL is greater than the time $T_0$ then the program moves to the step S3 so as to look up a compensation value for the amount of fuel supplied. These values are determined by looking at a look-up map such as the maps of FIGS. 13 and 14 which will vary depending upon the particular type of sensor employed. These variations of amounts will vary on the shift from rich to lean TRL and also from lean to rich TLR as shown by these two maps (FIGS. 13 and 14). The initial amount of injection PLR and PRL and the step amounts IRL, ILR, TRL, and TLR are adjusted in accordance with the values shown on these two maps.

Figure 11:
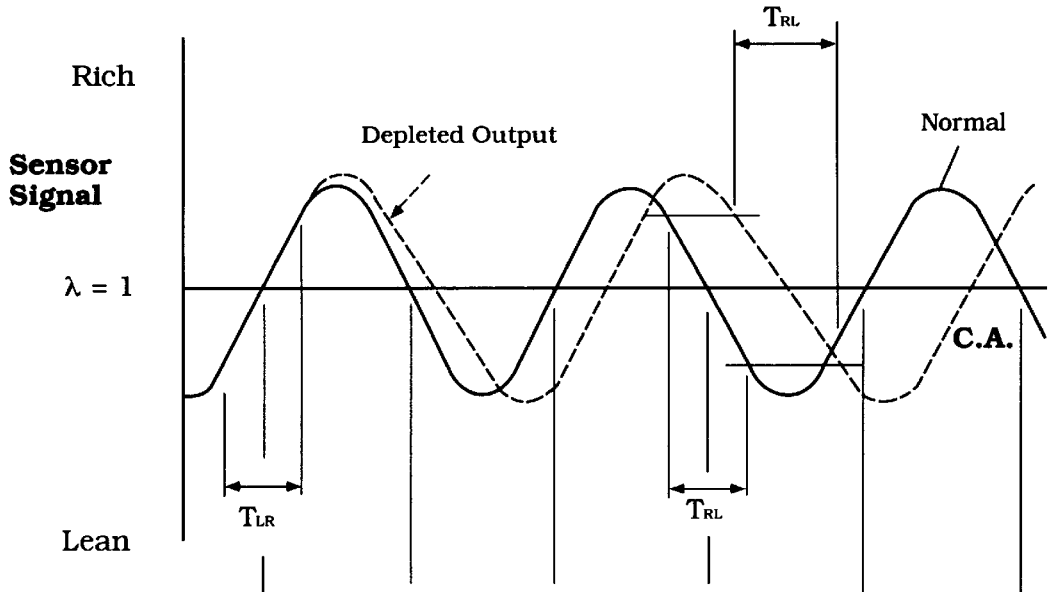
FIG. 11 is a graphical view showing the output of the oxygen sensor when operating in a normal mode and when in a depleted output signal mode for this embodiment and is in part similar to the explanatory view of FIG. 2.
Figure 12:
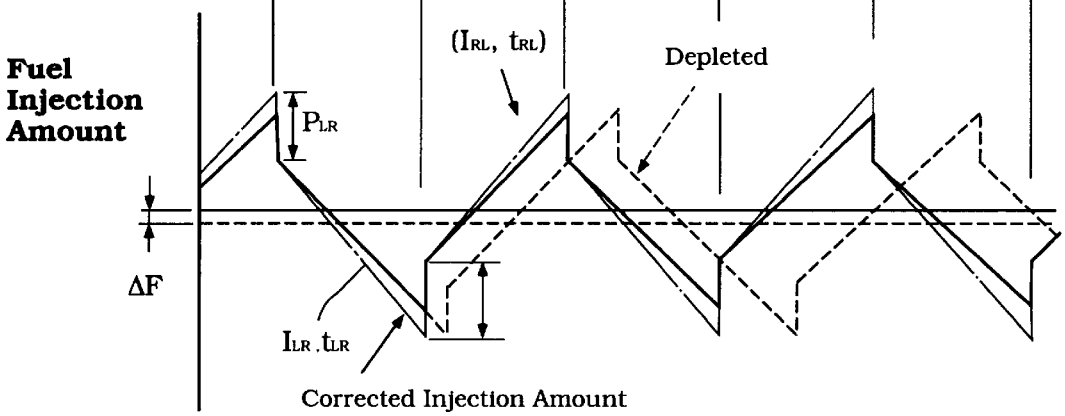
FIG. 12 is a graphical view showing the actual fuel injection amount both in a normal system, in a system that does not practice the invention in broken lines, and a system constructed and operated in accordance with this embodiment of the invention in dot-dash lines.

FIGS. 11 and 12 show the effect of this compensation variation. As may be seen in FIG. 11, when the time measurements TRL and TLR are made, it is determined if the time is normal or depleted. Thus, if uncompensated for, the operational curve will result in a decreased amount of fuel shown as ΔF in FIG. 12 which will delay the ability of the system to respond as shown by the depleted broken line curve results.

However, at the completion of the first cycle when the time period TRL has been extended, the program moves so as to provide both an increased amount of initial injection of fuel and/or increased incremental adjustments ILR/TLR so that the dot-dash line curve results. Thus, the response time can be kept the same and the fuel control maintained within the desired ratio by the expedient of changing the injection amounts to compensate for the deteriorated signals.

FIGS. 15 and 16 show another embodiment of the invention. This embodiment operates also to permit continued operation of the engine under feedback control even though the output signal may be depleted. This system operates so as to provide a different way in which the system maintains the control and this is done by increasing the upper and lower injection maximum permitted fuel injection amounts in the event of signal depletion detection. That is, most systems operate so as to provide a maximum and minimum permissible adjustment. This embodiment operates so as to increase those minimum adjustments in the event there is a depletion detected in the signal of the sensor.

Therefore, the ECU executing this program has the calculating sections as shown in FIG. 15 which are comprised of a section 301 which detects from engine running conditions the desired air-fuel ratio. The ECU also includes a section 302 which calculates the fuel injection volume necessary to achieve the desired air-fuel ratio. It further has a section 303 that calculates the measured TRL and section 304 that compares the calculated TRL with a threshold value $T_1$. If the value is greater than that, it moves to set higher and lower injection limits.

The effect of this may be seen in the curves of FIG. 16. FIG. 16A again shows the complete comparison of the normal signals and the depleted signals. The B portion of this figure shows how this depletion can cause a decreased injection amount indicated at Δf. However, by changing the maximum amount of fuel injection permitted, it is possible to maintain substantially the same response time as shown by the curves in FIG. 16B.

Figure 17:
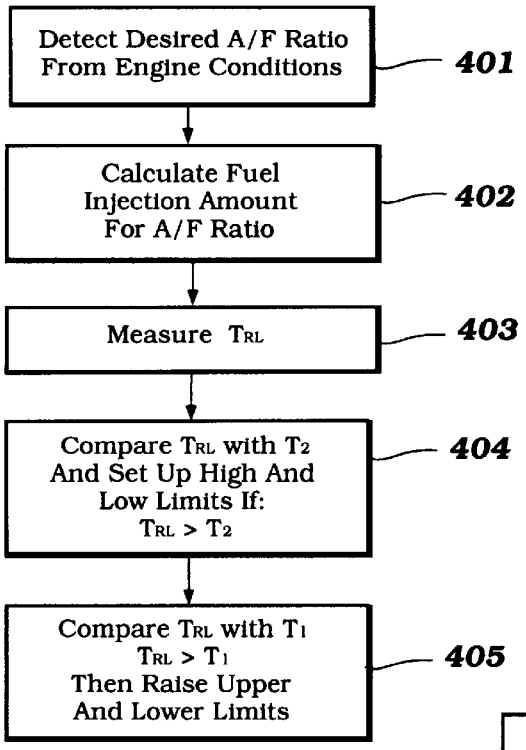
FIG. 17 is a graphical view showing the control routine in accordance with another embodiment of the invention.

FIG. 17 shows another control routine which may be accomplished. This control routine operates so as to provide both compensation as described in the first embodiment and the setting up of the maximum and minimum fuel injection amount limits as included in the second embodiment.

Therefore, in this embodiment, the ECU has a section 401 which operates so as to determine the desired air-fuel ratio for the engine running conditions.

The ECU also has a section 402 wherein the amount of fuel injection required to achieve the target air-fuel ratio is calculated.

Further, there is provided a section 403 that measures the time TRL to go from rich to lean.

A section 404 is provided that compares the response time TRL with the value $T_0$ and if it is greater, it goes to a lookup map as shown in FIGS. 13 and 14, so as to compensate the amount of fuel injection permitted during the adjusting cycle to compensate.

Also, the program has a section 405 which compares the value TRL with the higher limit value $T_1$ and to set up the upper and higher limits if the response time is greater than the time $T_1$.

Figure 18:
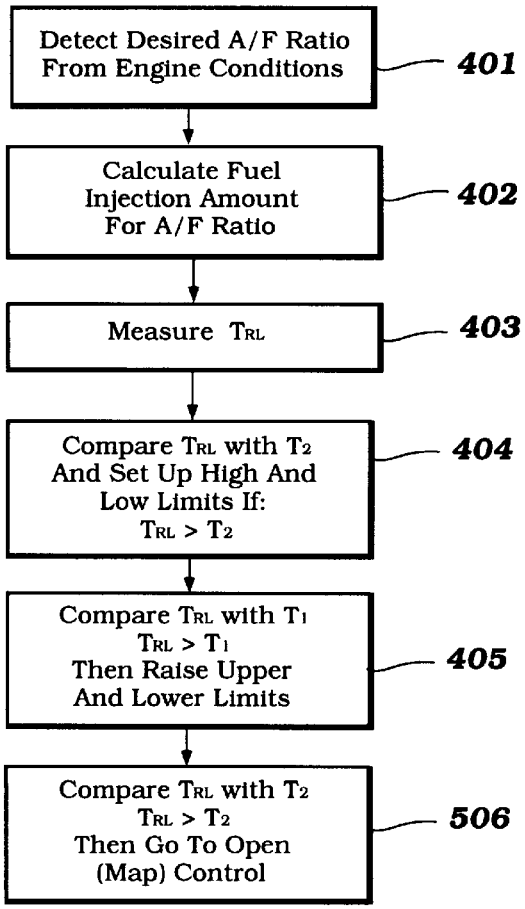
FIG. 18 is a graphical view showing the control routine in accordance with yet another embodiment of the invention.

FIG. 18 shows a still further embodiment of the invention. In this further embodiment, the ECU that executes the program includes all of the same sections as the embodiment of FIG. 18 and these sections are again illustrated in FIG. 18. However, this program has a still further section indicated at 506.

In this section 506, a comparison is made between the response time and a maximum permitted response time $T_2$. If this time is exceeded, then the program determines that the sensor output is not reliable enough so as to permit feedback control and the program reverses back to an open control utilizing only the fuel injection amount calculated in the stage 402.

Figure 19:
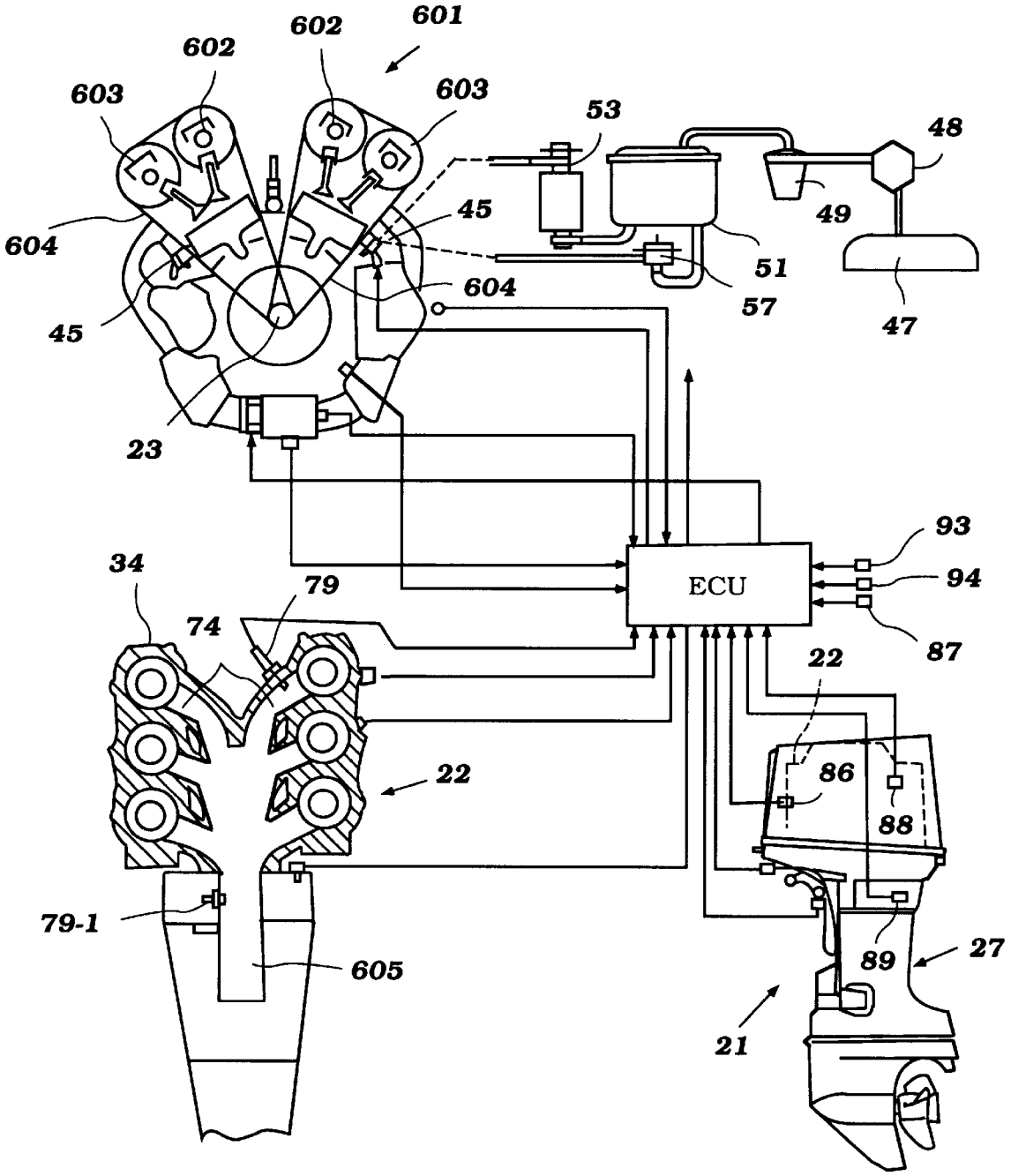
FIG. 19 is a multi-part view in part similar to FIG. 1, but shows an embodiment utilizing a four cycle engine.

It has been noted that the invention can be utilized also with 4-cycle engines. FIG. 19 is a single view in part similar to FIG. 1, but the engine, indicated by the reference numeral 601 in this figure, is of the 4-cycle type. As may be seen, the engine has twin overhead cam shafts on each cylinder bank comprised of intake cam shafts 602 and exhaust cam shafts 603. These cam shafts are driven from the crankshaft 23 by timing chains or belts 604. In this embodiment, the fuel injectors 45 are of the direct type and hence inject directly into the combustion chambers of the engine. The bulk of the remaining system is the same as that previously described and, therefore, components which are the same or substantially the same as the previously describe embodiment have been identified by the same reference numerals. In this embodiment, the sensor 79 may be mounted in one of the exhaust manifolds 74 or may be mounted in a single exhaust pipe 605 that collects the exhaust gasses from these manifolds. This alternative location is shown as 79-1 in FIG. 19.

Thus, from the foregoing description it should be readily apparent that the described embodiments of the invention provide very good exhaust emission control and fuel economy. This is done by utilizing an arrangement wherein the sensor output is monitored to determine if the sensor is effective. If it is providing a depleted signal, feedback control can still be maintained and would be effective and viable because it is adjusted to compensate for the amount of deterioration in the sensor.

Of course, the foregoing description is that of preferred embodiments of the invention, and various changes and modifications may be made without departing from the spirit and scope of the invention, as defined by the appended claims.

What is claimed is:

1. An internal combustion engine and control comprising a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, feedback control means for controlling the said charge-forming device for varying the fuel/air ratio supplied to said combustion chamber in response to the output signal from said combustion condition sensor, condition sensing means for sensing when the output signal from said combustion condition sensor has degraded, compensating means for adjusting said feedback control means to compensate for the degradation in said combustion condition sensor operation to maintain proper feedback control operation while continuing to maintain feedback control by said feedback control means based upon the degraded output of said combustion condition sensor, and means for switching said control to an open control if the condition sensing means indicates that corrected feed back control is undesirable, said open control being effective to adjust the amount of fuel supplied only from the intake air volume.

2. An internal combustion engine as set forth in claim 1, wherein the condition sensing means determines that the combustion condition sensor has degraded if the time for the combustion condition sensor signal to shift between rich and lean signals during feed back control exceeds a predetermined time.

3. An internal combustion engine as set forth in claim 2, wherein the control switches to an open control if the shift time for the sensor output to shift exceeds a second predetermined time greater than the first mentioned predetermined time.

4. An internal combustion engine as set forth in claim 1, wherein the compensating means adjusts the fuel air ratio to maintain the time of response between rich and lean signals to that of a normally operating combustion condition sensor.

5. An internal combustion engine as set forth in claim 4, wherein the condition sensing means determines that the combustion condition sensor has degraded if the time for the combustion condition sensor signal to shift between rich and lean signals during feed back control exceeds a predetermined time.

6. An internal combustion engine and control comprising a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, feedback control means for controlling the said charge-forming device for varying the fuel/air ratio supplied to said combustion chamber in response to the output signal from said combustion condition sensor, condition sensing means for sensing when the output signal from said combustion condition sensor has degraded, compensating means for adjusting said feedback control means to compensate for the degradation in said combustion condition sensor operation to maintain proper feedback control operation, and means for switching the control to an open control if the condition sensing means indicates that corrected feed back control is undesirable, said open control adjusting the amount of fuel supplied only from the intake air volume.

7. An internal combustion engine and control comprising a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, feedback control means for controlling the said charge-forming device for varying the fuel/air ratio supplied to said combustion chamber in response to the output signal from said combustion condition sensor, condition sensing means for sensing when the output signal from said combustion condition sensor has degraded, and compensating means for adjusting said feedback control means to compensate for the degradation in said combustion condition sensor operation to maintain proper feedback control operation by correcting the amount of incremental fuel supply amount from a map having combustion condition sensor response time as a parameter.

8. An internal combustion engine as set forth in claim 7, wherein the condition sensing means determines that the combustion condition sensor has degraded if the time for the combustion condition sensor signal to shift between rich and lean signals during feed back control exceeds a predetermined time.

9. An internal combustion engine as set forth in claim 8, wherein the control also switches to an open control if the condition sensing means indicates that corrected feed back control is undesirable.

10. An internal combustion engine as set forth in claim 9, wherein the open control adjusts the amount of fuel supplied only from the intake air volume.

11. An internal combustion engine as set forth in claim 10, wherein the control switches to an open control if the shift time for the sensor output to shift exceeds a second predetermined time greater than the first mentioned predetermined time.

12. An internal combustion engine and control comprising a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, feedback control means for controlling the said charge-forming device for varying the fuel/air ratio supplied to said combustion chamber in response to the output signal from said combustion condition sensor, condition sensing means for sensing when the output signal from said combustion condition sensor has degraded, and compensating means for adjusting said feedback control means to compensate for the degradation in said combustion condition sensor operation to maintain proper feedback control operation while continuing to maintain feedback control by said feedback control means based upon the degraded output of said combustion condition sensor, said compensating means correcting the maximum permitted amount of incremental fuel supply amount.

13. A method of operating an internal combustion engine having a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, and feedback control means for controlling said charge-forming device for varying the fuel/air ratio supplied to said combustion chamber in response to the output signal from said combustion condition sensor, said method comprising the steps of sensing when the output signal from said combustion condition sensor has degraded, and adjusting said feedback control means to compensate for the degradation in said combustion condition sensor operation to maintain proper feedback control operation, switching to an open control if the combustion condition sensor condition sensing indicates that corrected feed back control is undesirable by adjusting the amount of fuel supplied only from the intake air volume.

14. A method of operating an internal combustion engine as set forth in claim 13, wherein it is determine that the combustion condition sensor has degraded if the time for the combustion condition sensor signal to shift between rich and lean signals during feed back control exceeds a predetermined time.

15. A method of operating an internal combustion engine as set forth in claim 14, wherein the control switches to an open control if the shift time for the sensor output to shift exceeds a second predetermined time greater than the first mentioned predetermined time.

16. A method of operating an internal combustion engine having a combustion chamber, an induction and charge-forming system for supplying fuel and air to said combustion chamber, means for igniting a charge in said combustion chamber for initiating combustion therein, exhaust means for discharging exhaust gases from said combustion chamber, a combustion condition sensor for sensing combustion condition in said combustion chamber and providing an output signal indicative of the combustion condition, and feedback control means for controlling said charge-forming device for varying the fuel/air ratio supplied to said combustion chamber in response to the output signal from said combustion condition sensor, said method comprising the steps of sensing when the output signal from said combustion condition sensor has degraded, and adjusting said feedback control means to compensate for the degradation in said combustion condition sensor operation to maintain proper feedback control operation, the amount of incremental fuel supply amount being corrected from a map having combustion condition sensor response time as a parameter.

* * * * *